US011577302B2

(12) United States Patent
Cumersdale et al.

(10) Patent No.: US 11,577,302 B2
(45) Date of Patent: Feb. 14, 2023

(54) FASTENER PLACEMENT TOOL

(71) Applicant: AVDEL UK LIMITED, Sheffield (GB)

(72) Inventors: Tim Cumersdale, Letchworth Garden (GB); Angus Seewraj, Letchworth Garden (GB)

(73) Assignee: Avdel UK Limited, Hertfordshire (GB)

( * ) Notice: Subject to any disclaimer, the term of this patent is extended or adjusted under 35 U.S.C. 154(b) by 0 days.

(21) Appl. No.: 17/486,199

(22) Filed: Sep. 27, 2021

(65) Prior Publication Data

US 2022/0008982 A1 Jan. 13, 2022

Related U.S. Application Data

(63) Continuation of application No. PCT/EP2020/060763, filed on Apr. 16, 2020.

(30) Foreign Application Priority Data

May 23, 2019 (GB) ..... 1907290

(51) Int. Cl.

| | |
|---|---|
| ***B21J 15/34*** | (2006.01) |
| ***B21J 15/26*** | (2006.01) |
| ***B21J 15/04*** | (2006.01) |
| ***B21J 15/10*** | (2006.01) |
| ***B21J 15/28*** | (2006.01) |

(52) U.S. Cl.

CPC ..... *B21J 15/34* (2013.01); *B21J 15/105* (2013.01); *B21J 15/26* (2013.01); *B21J 15/28* (2013.01); *B21J 15/043* (2013.01)

(58) Field of Classification Search

CPC . B21J 15/34; B21J 15/105; B21J 15/26; B21J 15/28; B21J 15/043

See application file for complete search history.

(56) References Cited

FOREIGN PATENT DOCUMENTS

| | | | | |
|---|---|---|---|---|
| AU | 702149 B | | 2/1999 | |
| EP | 3335816 A | | 6/2018 | |
| EP | 3335816 A1 | * | 6/2018 | |
| GB | 578104 A | * | 6/1946 | ..... B21J 15/34 |
| GB | 582428 A | | 11/1946 | |

OTHER PUBLICATIONS

Thiele, EP-3335816-A1 Machine Translation, Jun. 2018 (Year: 2018).*

International Search Report & Written Opinion dated Aug. 13, 2020 cited in corresponding PCT Application No. PCT/EP2020/060763.

* cited by examiner

*Primary Examiner* — Lee A Holly

(74) *Attorney, Agent, or Firm* — Kofi A. Schulterbrandt

(57) ABSTRACT

A fastener placement tool has a mandrel able to place a series of captive rivets in sequence. The tool employs a single electric motor capable of driving the tool into either a first cycle for rivet placement, to a second cycle for selective release of the mandrel form the tool for rivet replenishment. The tool includes a user-operable switch actual to select which of the first or second cycle the tool is to operate.

13 Claims, 24 Drawing Sheets

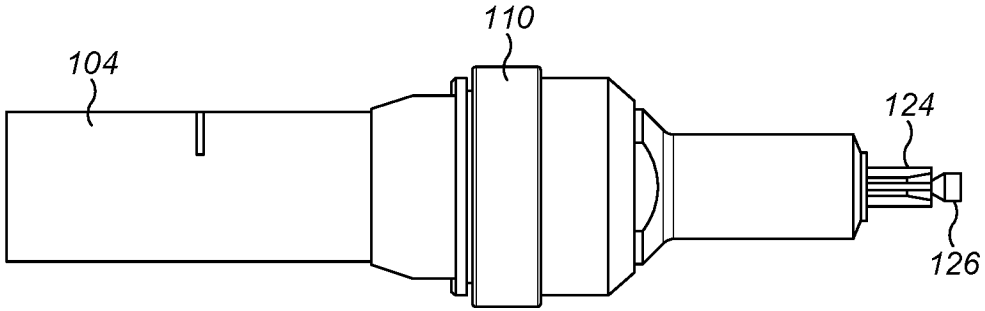
FIG. 10a
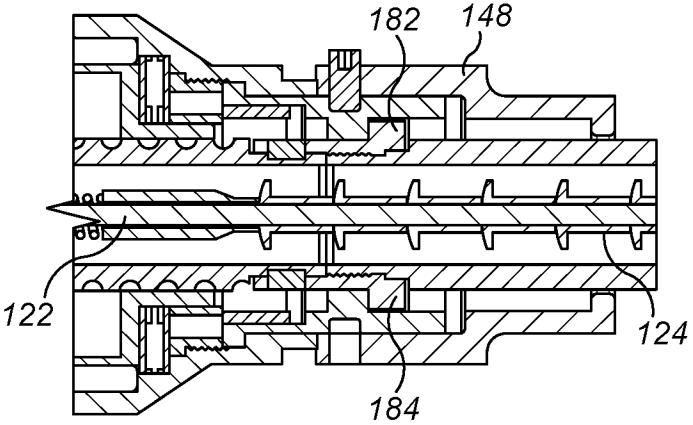

FASTENER PLACEMENT TOOL

CROSS-REFERENCE TO RELATED APPLICATIONS

This application is a continuation of PCT Application No. PCT/EP2020/060763, filed on Apr. 16, 2020 which claims priority from British Application No. 1907290.9, filed on May 23, 2019, the entire disclosure of which is incorporated herein by reference.

BACKGROUND OF THE PRESENT INVENTION

The present invention relates generally to a fastener placement tool and has particular, although not exclusive, relevance to such tools as are used to place blind-side rivets.

Fastener placement tools are well known and those used for placement of so-called blind-side rivets are often used to repeatedly place rivets of a specified length and diameter. Such repeated placement may occur, for example, in manufacturing environments, such as assembly lines, or the like.

Where repeated placement of rivets (or other types of fastener) occurs, there may also be the need for such repeated placement to be as rapid as possible, in order to enhance the efficiency of the installation and placement process. Again, if the environment is that of a manufacturing assembly line, then speed of rivet placement is important. To this end, there are well-known rapid placement tools, such as the NeoSpeed® Speed Fastening® tool supplied by Avdel UK, Ltd. An example of such a rapid rivet placement tool is shown, for example, in GB 2,482,162-A. In this prior art disclosure, a magazine of rivets for placement is held within the placement tool such that rapid sequential placing of the rivets occurs.

Placement tools for rapid rivet placement such as the one discussed above are usually of hydro-pneumatic design. Normally the motive forces used to place the rivets commence with a pneumatic system operating using a source of compressed air to drive a hydraulic system within the tool to advance and place the rivets.

Such hydro-pneumatic tools suffer from certain shortcomings: their design is inherently complex, as the combination of both hydraulic and pneumatic control systems is employed; they tend to be unwieldy due to the need for a source of compressed air, which is supplied to the tool via hoses—this makes their repeated and long-term use often troublesome for an operative who has to both manipulate and hold the tools when placing rivets.

SUMMARY OF THE PRESENT INVENTION

It is, therefore, an object of the present invention to at least alleviate the above shortcomings by provision of a fastener placement tool according to the appendant claims which, instead of hydro-pneumatic systems to control operation of the tool, uses an electro-mechanical one. This makes the tool more manually dextrous than has hitherto been the case, with attendant advantages for the operator for use over the longer term. Use of electro-mechanical drive systems may also reduce the amount of "down time" of the tool—this being time during which the tool needs servicing, for example, and during which time the tool cannot be used.

Rivets to be placed by a rapid placement tool are all pull-though ones, such as those disclosed in GB 1,323,873-A. As is known in the art, these pull-through rivets are all blind-side placed fasteners for which the placement operation requires the enlarged head of the mandrel to be pulled through the body of the rivet (from the blind side of the workpieces to be joined, remote from the operator of the tool to the operator-side). This operation, particularly when occurring as a sequential rapid-placement one, results in wear of the mandrel, the mandrel head and the tool jaws which control operation of the mandrel. This ultimately necessitates replacement of the worn tool parts over time.

With the known placement tools employing hydraulic and pneumatic control systems, replacement of worn tools parts, particularly the jaws used to grasp and control the mandrel, is a lengthy process, often requiring at least partial disassembly of the whole tool. Particular care needs to be taken with such disassembly, as damage to either the hydraulic or the pneumatic systems could be costly to repair. It is, therefore, a further aim of the present invention to avoid the need for such tool disassembly by employing a replaceable element, such as an exchangeable cartridge for the tail jaws used to hold and control the mandrel.

BRIEF DESCRIPTION OF THE DRAWINGS

An embodiment of the present invention will now be described, by way of example only and with reference to the following drawings, of which:

FIG. 10*a* shows, on the left-hand side thereof a side sectional view of the nose piece part of the tool before the rivet placement cycle commences, and, on the right-hand side thereof the corresponding side view of the distal end of the mandrel.

FIG. 10*d* being the home, or starting position of the placement cycle and each of FIGS. 10*e*, 10*f* and 10*g* showing, respectively, an advancement of the mandrel to the right of the figures.

FIG. 11*c* being the home, or starting position of this second cycle and each of FIGS. 11*d*, 11*e* and 11*f* showing, respectively, a retraction of the mandrel to the left of the figures.

DETAILED DESCRIPTION OF THE PREFERRED EMBODIMENTS

Figure 1:
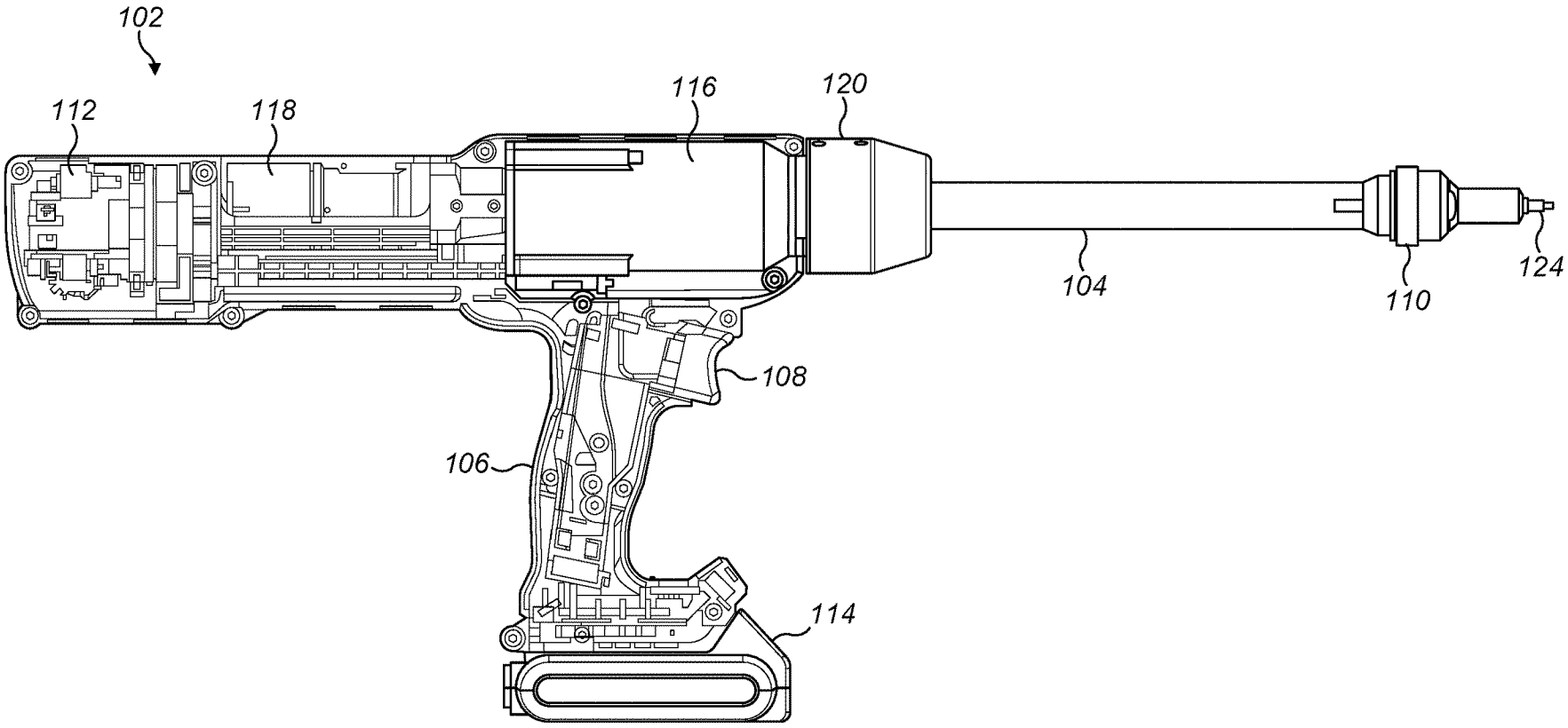
FIG. 1 shows a part-sectioned schematic view of a tool in accordance with the present invention.
Figure 2:
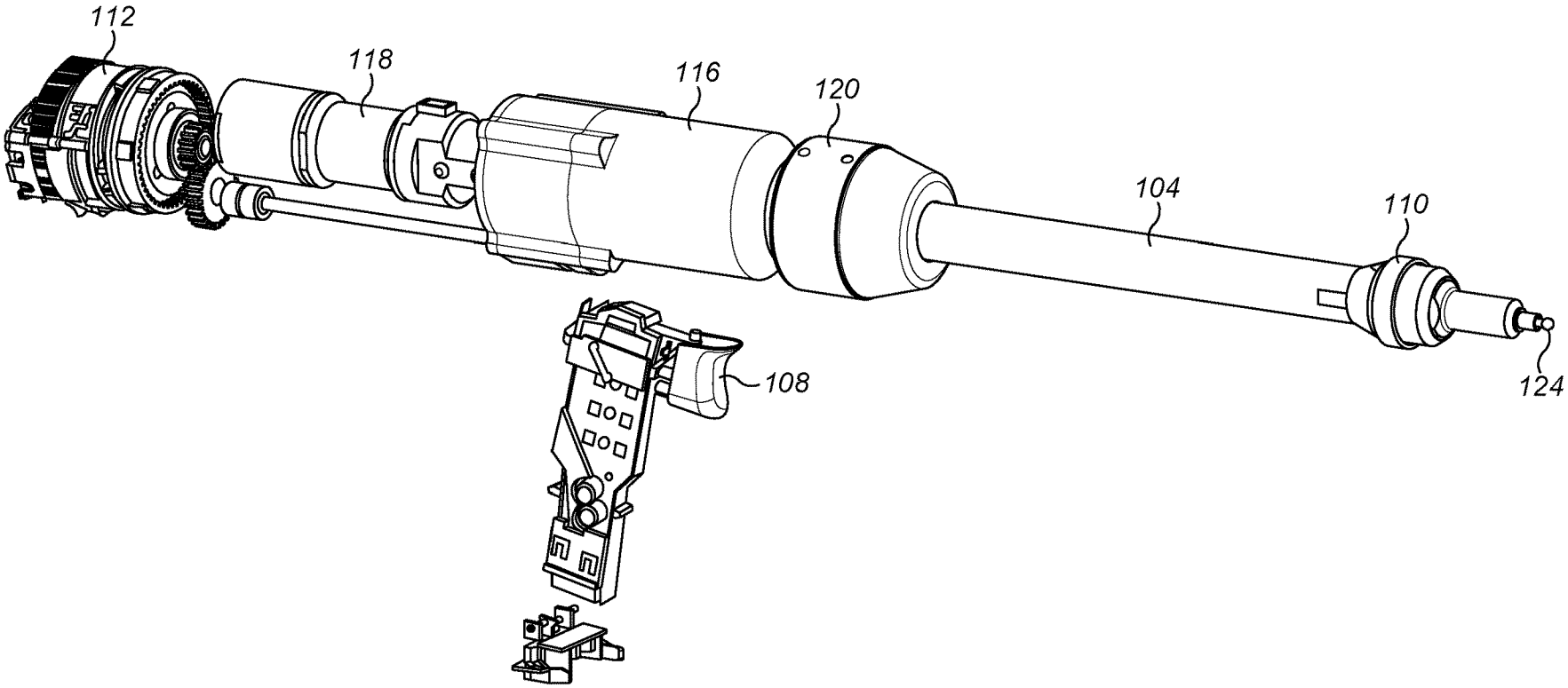
FIG. 2 illustrates, schematically, an exploded view of the major components of the tool of FIG. 1.

Referring firstly to FIGS. 1 and 2, the fastener insertion tool 102 in accordance with the present invention comprises a barrel 104, formed as an axially-extending hollow metallic cylinder, in this example, aluminium, having a distal and a proximal end. In FIG. 1, the distal end is to the right of the figure and the proximal end is to the left. The tool 102 includes a user-graspable handle 106 which has formed thereon an actuation trigger 108. This means that the proximal end of the barrel 104 is adjacent the tool handle 106.

The distal end of the barrel 104 has formed thereon a nose jaw assembly 110, which will be described in detail below. The purpose of the nose jaw assembly is to form the contact point between the tool 102 and the workpieces to which fasteners are to be applied and to locate the fasteners during their placement operation, as will be explained below.

The fasteners with which the tool 102 operates are so-called blind fasteners, in this example rivets 124. Blind fasteners are well-known to those skilled in the art and comprise fasteners which may only access one side of a workpiece and whose placement therein is actuated from the remote side of the workpiece which is inaccessible by an operative.

On the opposite side of the handle 106 to the barrel 104 is an electric motor 112. The electric motor is operated by a battery 114, attached to the base of the handle 106 and provides motive force to the barrel 104 via a drive assembly 116, to which the motor 112 is operatively coupled. Also between the handle 106 and motor 112 is a jaw assembly, here removable jaw cartridge 118.

Mounted on the barrel 104 and coupled to the drive assembly 116 is a user-operable switch 120 whose operation is to both i) set the axial position of the barrel pre-fastener placement, or jaw operation and ii) also to select the mode of operation of the barrel between fastener placement and jaw operation.

Figure 3:
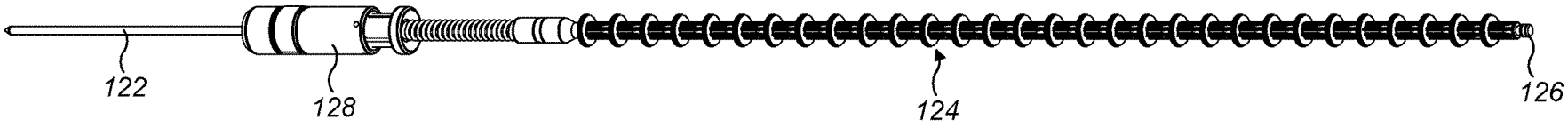
FIG. 3 shows a schematic side view of a mandrel for use with the tool of the present invention, which mandrel has mounted thereon a series of captive rivets for placement.

Reference now also to FIG. 3 shows a mandrel 122 on to which are placed a series of captive rivets 124 (one of which rivets 124 is shown in FIG. 1 at the far distal end of the barrel 104 held by the nose jaw assembly 110). The extreme distal end of the mandrel (the right-hand side of FIG. 3) terminates in a diametrically enlarged head 126, as will be understood by those skilled in the art of fastener placement. The proximal end of the mandrel (to the left-hand side of FIG. 3) includes an end stop 128, here a mechanical cursor. The end stop 128 moves along the mandrel 122 in indexed steps, one for each placement, as the fasteners 124 are placed, in order to maintain a rivet for placement at the distal end of the mandrel 122, as will be described below. The mandrel assembly (i.e., the mandrel and its captive rivets) are loadable into the hollow barrel by a user of the tool. In order for this to occur, the jaws (to be described below) within the jaw cartridge 118 need to be in their release, or open, position to allow the proximal end of the mandrel to be inserted thereinto.

Figure 4:
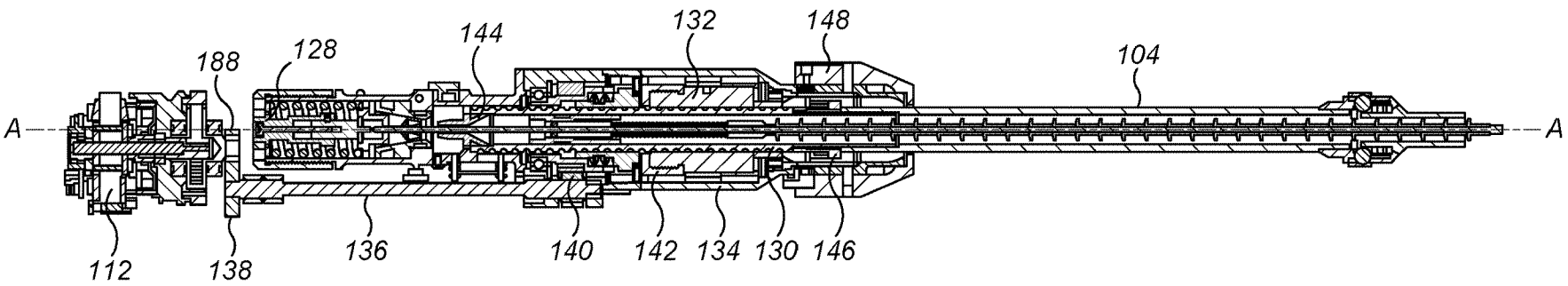
FIG. 4 shows a plan side section of the major components of FIG.
Figure 5:
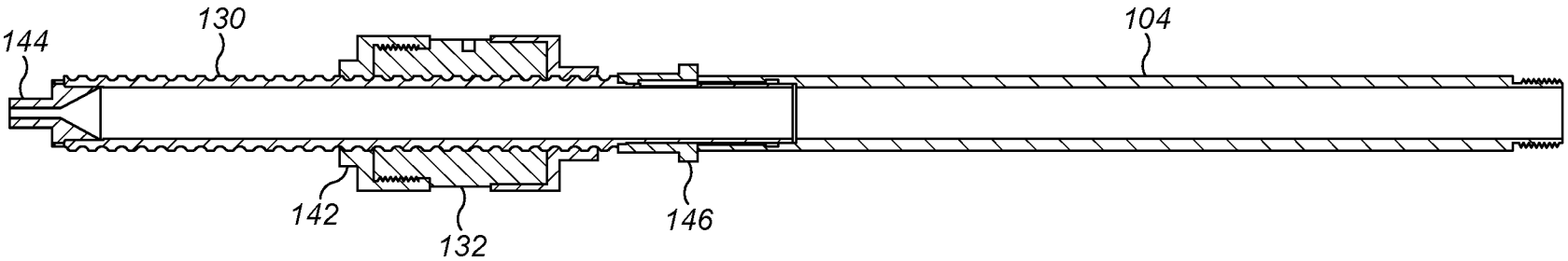
FIG. 5 shows a side sectional view of the barrel of FIG. 4, including the ball nut 132.

Referring now also to FIGS. 4 and 5, it can be seen that the barrel 104 has formed thereon, along a part of its axial extent, an external helical groove 130 onto which is mounted a rotatable ball nut 132. The ball nut 132, which has an internal helical thread form to mate with the groove 130 on the barrel 104, is held within a casing 134 of the drive assembly so that it is able only to rotate and not move axially. Rotation of the ball nut 132, therefore, causes axial movement of the barrel 104, as the barrel is able only to undergo fore-aft linear movement along its axis (A-A, in FIG. 4). Rotation of the ball nut 132 is effected by operation of the motor 112, which is coupled to the ball nut 132 by drive shaft 136. As is common in the art, either end of the drive shaft 136 carries journaled pinions 138, 140.

Intermediate the drive shaft pinion 140 and the ball nut 132 is a clutch, in this example, bi-directional clutch 142, which is described in more detail below with particular reference to FIG. 9. The clutch 142 acts to normally permit rotational drive to be passed from the motor 112, via the drive assembly (136, 138, 140) to the ball nut 132 until one of two conditions occurs: i) the barrel reaches the limit of either its fore- or its aft-travel, or ii) the torque applied to the ball nut 132 exceeds a predetermined limit. As the barrel may move in one of two directions (axially fore or axially aft), then the clutch is bi-directional.

From the proximal end of the barrel 104, at the limit of one end of helical groove 130, is a jaw spreader 144. The jaw spreader is used to open the jaws held within the jaw cartridge 118, only when the barrel travels to the limit of its aft-direction and then only under other circumstances to be explained below. At the other end of the helical groove 130 there is formed a dead stop 146. The dead stop is formed at the transition of the barrel surface where the helical groove 130 meet the main body of the barrel 104 and acts to prevent the forward movement of the barrel 104 (i.e., to the right of the figures) from overstroking during placement of a rivet 124.

In the foregoing with reference to FIG. 5, it will be understood that this drawing shows only the driven-side of the clutch 142.

Looking now also to FIG. 6, at the forward end of the drive assembly casing 134 is formed a user-operable switch, in this example, rotatable nose piece 148. The nose piece is axially fixed to the housing 134, but able to rotate in order to select one of two cycles of the barrel 104. In one of the cycles, the fore-aft movement of the barrel 104 achieves placement of a rivet and resetting for placement of the next successive rivet. Whereas in the other cycle, the fore-aft movement of the barrel 104 achieves release or retention of the mandrel 122 by the jaws 150 in the jaw cartridge 118. In a preferred embodiment, the rotation of the nose piece 148 into either respective position in order to select the first cycle or the second cycle, may also set a predetermined axial position of the barrel 104 relative to the drive assembly 116.

This means that the starting axial position of the barrel 104 relative to the casing 134 may differ as between the barrel's first cycle and its second cycle. However, in the example shown in the attached figures, the barrel 104 has a single starting (or "home") position common the both the first and second cycles. Although not described in detail herein, those skilled in the art will appreciate there are many ways in which rotation of the nose piece 148 can initiate a selective one of the two cycles mentioned above. For example, location of two micro-switches on the inner surface of the nose piece 148 may make or break an electrical circuit which then initiates a routine for the appropriate cycle.

The nose piece 148 has formed internally therein two sets of tabs, 176 and 178, which, in this example comprise diametrically-opposed pairs: 176 and 178. The pairs of tabs are axially off-set, as can be seen most easily from FIG. 6*a*. The first set of tabs 176 are used to actuate the first barrel 104 cycle and the second set of tabs 178 are used to actuate the second barrel 104 cycle. The two sets of tabs 176, 178 are chosen here to be such that the user is required to rotate the nose piece 148 by 45° in order to toggle the tool 102 between either the first barrel cycle, or the second barrel cycle.

Figure 7:
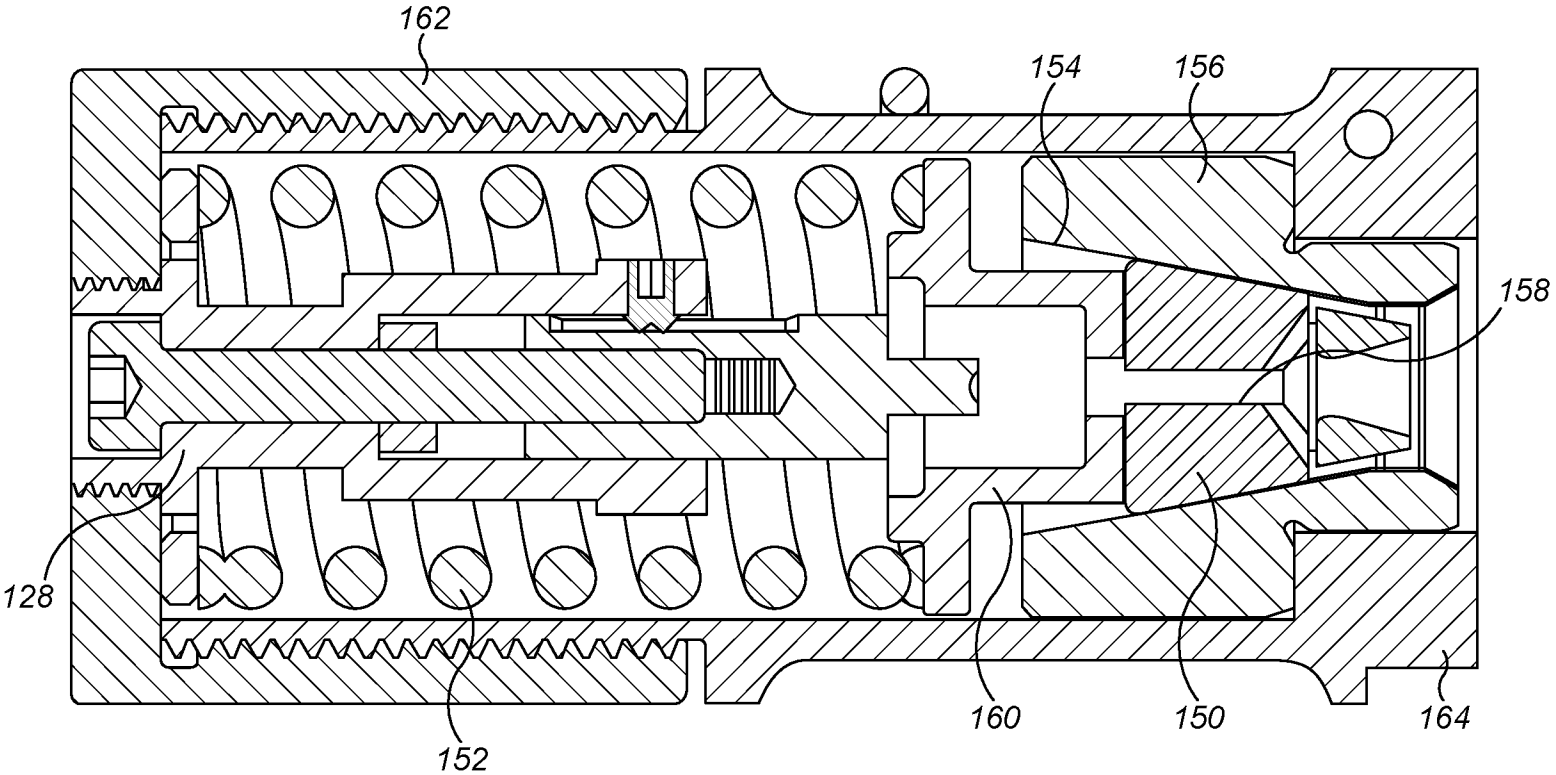
FIG. 7 shows a side sectional view of the mandrel-retaining jaws and jaw cartridge.

Considering now FIG. 7, the manner in which the mandrel 122 is held and released by the jaws 150 of the jaw cartridge 118 will be explained. It will periodically be necessary to remove the mandrel 122 from the barrel—most frequently to re-stock the mandrel with new rivets 124 for placement. However, the safe retention of the mandrel should be the default position, so that the user cannot inadvertently detach the mandrel 122 from the tool 102. For this reason, the "fail-safe" position of the jaws within jaw cartridge is to engage with the mandrel 122 to restrain the mandrel within the barrel 104. In order to achieve this, the jaws 150 are spring biased by compression spring 152 into engagement with the mandrel (not shown in FIG. 7). The jaws (which can be seen in the sectional view of FIG. 7; in the embodiment shown, there are 2 jaws circumferentially spaced at 180° intervals) are able to travel only radially inwards or outwards within a conical taper 154 of retainer nut 156. The internal faces 158 of the jaws are serrated to enhance their grip on the mandrel.

Whilst the jaws 150 are, themselves able to travel only radially, they are held within axially moveable turret 160. In this manner, axial movement of the turret 160 will cause the jaws to move radially (inwards, if the turret 160 moves to the left of FIG. 7; and outwards if the holder, here jaw turret 160 moves to the right of FIG. 7). The turret 160 is biased to the right of FIG. 7 (i.e., towards and into engagement with the inner wall of taper 154) so that the jaws 150 tend to be urged radially inwardly, thus tending to grasp a mandrel 122 inserted therebetween.

The cartridge 118 includes the mandrel end stop 128. A further purpose of the end stop 128 is to ensure that, when a user inserts a mandrel 118 into the barrel 104 of the tool, the mandrel is positioned in a repeatably known position before the tool commences its functions. Both the end stop 128 and spring 152 are held in place (and the spring has known tension applied thereto) by an adjustable screw cap 162. The screw cap 162 and the co-operable foremost part of the housing 164, together form the outer shell of the jaw cartridge 118.

Figure 8:
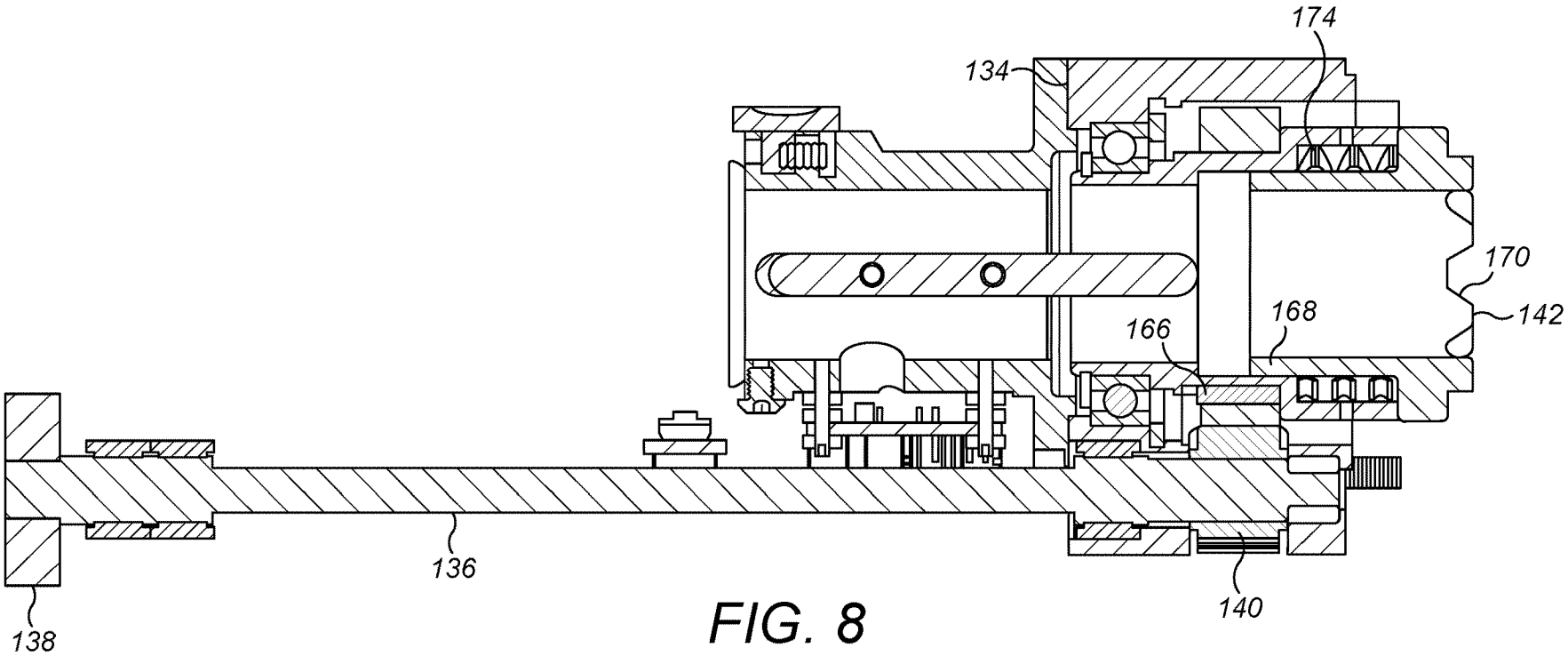
FIG. 8 shows a part side-sectional view of the drive side of the clutch and its connected components.

Looking now also at FIGS. 8 and 9, the structure of the clutch 142 mechanism will be explained in more detail. On actuation of the motor 112, the drive shaft 136 rotates so as to cause concomitant rotation of pinion 140. As the pinion 140 is mated with spur gear 166 formed on the external surface of clutch casing 168, then clutch 142 also rotates. Rotation of the clutch 142 will cause concomitant rotation of the ball nut 132, unless one of two torque conditions occurs.

Figure 9B:
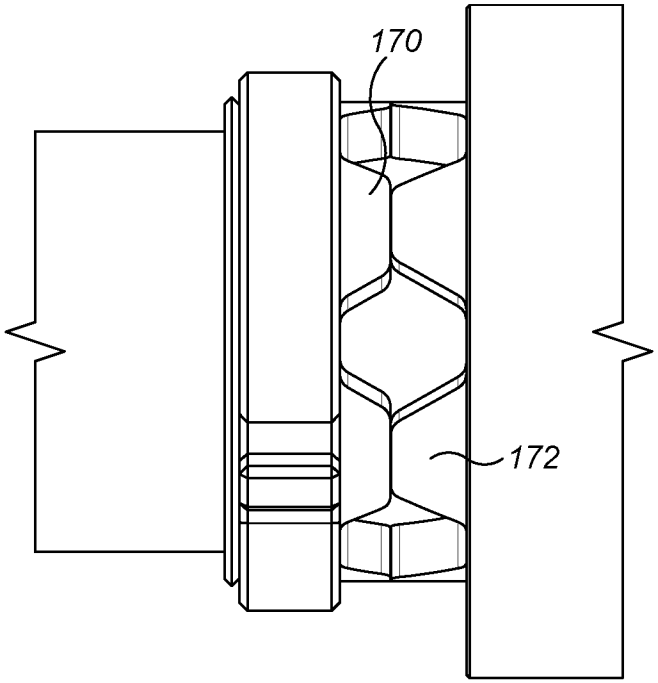
FIG. 9*b* shows a side elevation of the clutch mechanism in its disengaged state.
Figure 9A:
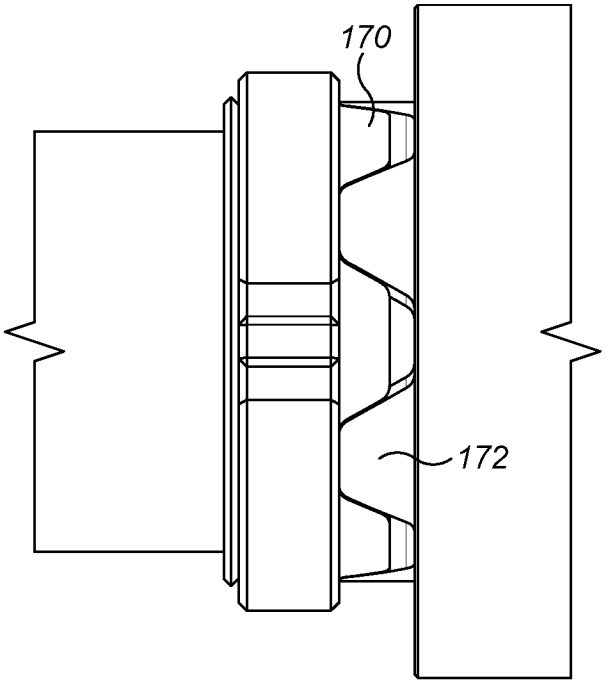
FIG. 9*a* shows a side elevation of the clutch mechanism in its engaged state.
Figure 14:
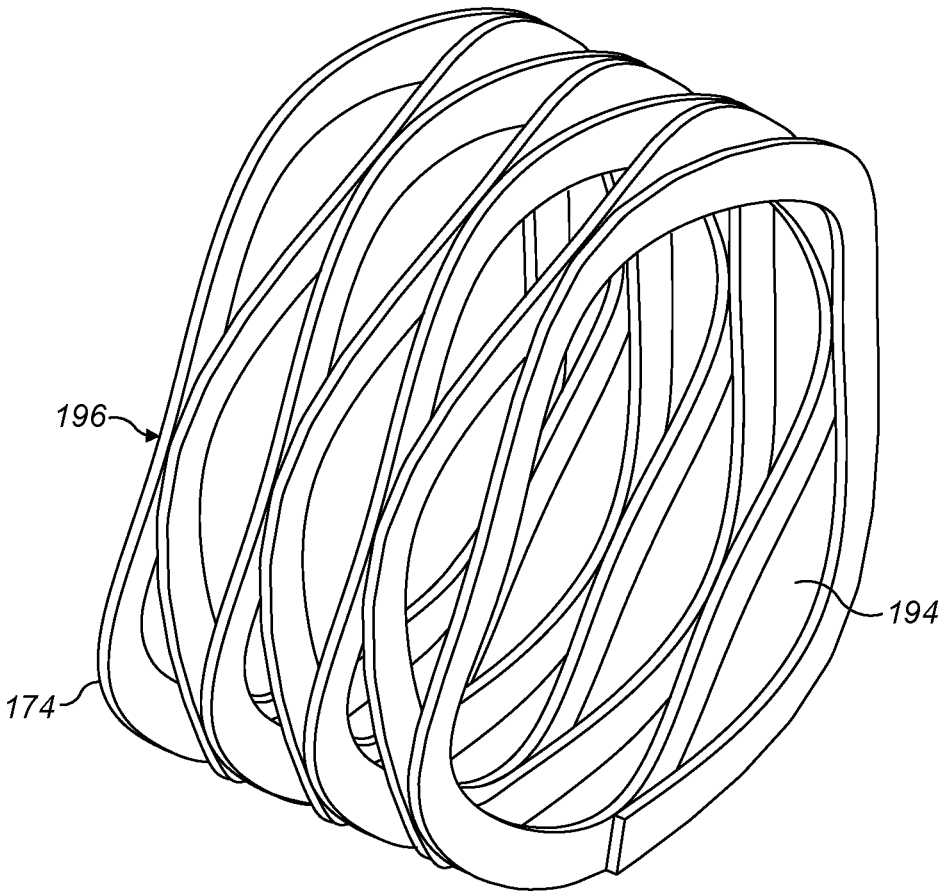
FIG. 14 shows a perspective view of the wave spring of FIG. 10*b*.

Clutch 142 is a bi-directional clutch, formed of two sets (170, 172) of mating tapering teeth profiles, shown most clearly in FIGS. 9*a* and 9*b*. The two sets of teeth—the drive-side teeth 170 and the driven-side set of teeth 172 are biased into co-operative engagement via a spring, in this example a compression spring 174 (shown in detail at FIG. 14) which, in this example is a wave-spring. The tension in the spring 174 is chosen, in known manner, to ensure that the teeth sets 170, 172 engage only up until a predetermined torque exists therebetween. At this predetermined torque, the first set 170 (which can be seen from FIGS. 9*a* and 9*b* to be less axially-extending than the second set 172) are urged up the ramp formed between the engaging faces of the two teeth sets. This ramping movement causes axial movement (to the left of FIGS. 8 and 9) of the set 170 against the spring 174 tension, hence disengaging drive to the ball nut 132. Also, from FIGS. 9*a* and 9*b* it can be seen that the first set of teeth 170 have slightly rounded end faces providing a shallower ramp face than those of the second set 172, thus ensuring smooth ramping of the first set 170 over the second set of teeth 172 when the clutch drive is disengaged. Those skilled in the art will appreciate this is not a necessary feature of the clutch 142, but a preferred one. Also, the differing ramp angles may be shared between the teeth sets 170 and 172, or even mixed within each teeth set. The aim of smooth ramping can be achieved by any variation of this principle.

Disengagement of the clutch drive (which will be explained below) is necessary in either of two conditions: i) when the barrel 104 reaches the limit of either its fore- or aft-travel. This condition occurs when a rivet 124 has been placed, or when the barrel is fully retracted to open the jaws 150 (when the dead stop 146 reaches the rearward limit of its travel within jaw cartridge 118), or; ii) when an over-torque condition occurs, such a bad placement of a rivet or internal drive blockage within the tool. In either case, it is important to disconnect the drive from the motor 112 to the ball nut 132 so that no damage to the tool mechanism occurs. As the barrel operates in both a fore- and aft-axial direction, the clutch 142 needs to be bi-directional.

Looking now at the operation of the tool 102 and how those features briefly described above operate together during such operation, reference is made also to FIGS. 10(*a*)-(*c*). As has been mentioned above, the barrel 104 is operable in either of two cycles. The first cycle is used to place a rivet 124 in a workpiece and the second cycle is used to clamp or release the jaws 150, respectively onto or from the mandrel 122.

Considering the first cycle, the barrel 104 may preferably, although not necessarily, commence from a home position. This is the rest position at which the barrel 104, when not in operation, will resume and from which any operation will start. The reason a home position is preferable is that the axial fore- and aft-movement of the barrel 104, in this example, is controlled by counting the number of turns made by the ball nut 132, which, in turn, dictates the linear advancement or retraction (depending upon the sense of rotation of the ball nut 132) of the barrel 104. In the present example, the fore-movement of the barrel is to a different axial extent than that of the aft-movement of the barrel.

Once the operator sets the angular position of the nose piece 148 into its appropriate position such as to select the first cycle (barrel operation), then software (whose detailed operation is not described herein, as that is not germane to the present invention) controlling operation of the motor (see also the software control flow chart at FIG. 13) then sets the motor 112 to rotate in the correct sense to cause rotation of the ball nut 132 such that the barrel moves in the fore direction (to the right of all the figures). Inside the nose piece 148 is arranged a barrel advance stop member 180 designed to ensure the barrel 104 cannot advance too far when placing a rivet 124. The stop member 180 does not rotate with the ball nut 132, but (like the barrel 104) is held against rotation and is permitted only to advance or retract in a linear axial direction. During the fore-movement of the barrel 104, if the stop member 180 makes contact with nose piece inner sleeve 186, then further advancement of the barrel 104 is prevented, as the first set of clutch teeth 170 will ramp over the second set 172, thus disengaging drive from the ball nut 132 to the barrel 104. It will be appreciated that this condition should not normally occur, however, as the rotation counting routine will, before then, have counted that the requisite number of turns of the ball nut 132 has occurred and reversal of the sense of rotation of the motor 112 will have been effected. At the limit of the fore-movement of barrel 104, a rivet 124 will have been placed. This rivet placement, per se, is not described herein, as it is well-known to those skilled in the art of blind rivet placement. Those skilled in the art will appreciate that on placement of each fastener in accordance with the present invention, does not result in the mandrel stem being broken, as speed riveting such as this requires the mandrel to remain intact for all fastener placement.

At its forward end, the barrel advance stop member 180 has formed, diametrically opposite each other, two bayonet tabs 182, 184. The bayonet tabs 182, 184 selectively engage with the nose piece tabs 176, 178 (FIG. 6(*b*)), depending upon the rotational orientation of the nose piece (ie to which cycle it is set) and the degree of axial advancement of the barrel 104. At the home position (ie before commencement of the barrel movement in the first cycle), the bayonet tabs 182, 184 are to the left of the nose piece 148, as seen most readily in FIGS. 10(*a*), (*b*) and 10(*d*). As also shown in FIG. 10(*d*), the rivets 124 held on mandrel 122 have not been advanced and so the distal-most rivet is held in nose jaw assembly 110. Those skilled in the art will understand the operation of the nose jaw assembly and how it functions to place the rivets 124. As the rivet placement is, per se, not germane to the present invention, it will not be described in any detail herein. However, the present invention is understood to require a working knowledge of the general operation of multiple blind-side rivet placement from a mandrel whose stem remains unbroken after rivet placement.

It will be understood that nose piece 148 is mechanically linked with inner sleeve 186. So, when the nose piece 148 is rotated counter-clockwise (as seen in FIG. 6c), this chooses the first cycle. The tab pairs 176 and 178 rotate with nose piece 148 to create a channel for the bayonet tabs 182 and 184 to move axially forward (to the right of FIG. 11). Tab 178 prevents the bayonet tabs 182 and 184 from over-actuation in the axial aft-direction thus creating a mechanical limit. This locks the rotation of ball nut 132 and overload is then detected causing clutch 142 to slip. Tab pair 176 act as a guide to prevent a tool user from rotating the nose piece 148 during operation of this first cycle.

Figure 6B:
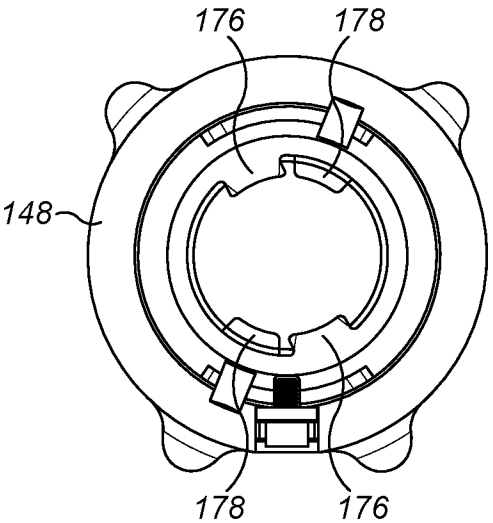
FIG. 6*b* shows a front sectional view of the nose piece along the line B-B of FIG. 6*a*.
Figure 6A:
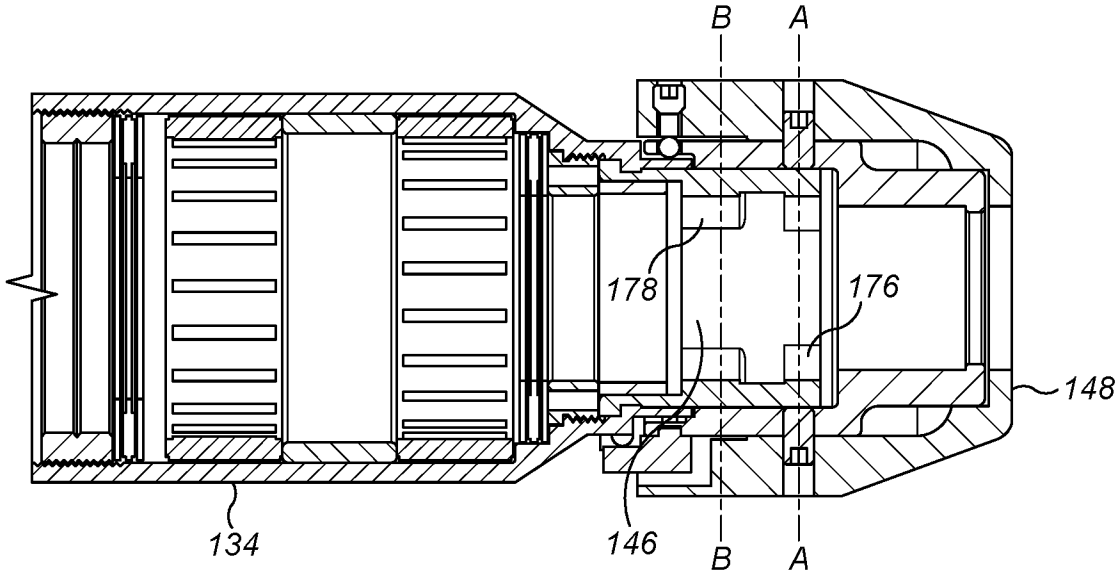
FIG. 6*a* shows a side part-sectional view of the drive assembly and nosepiece.
Figure 6D:
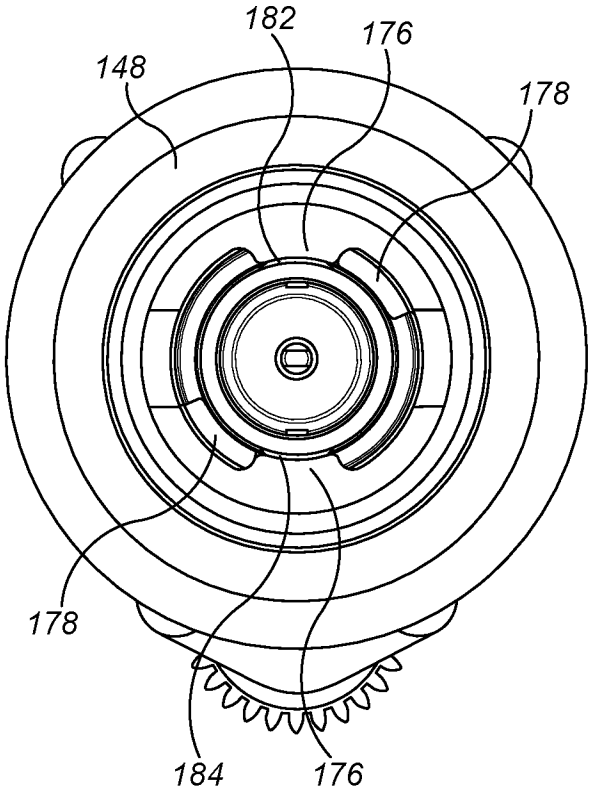
FIG. 6*d* shows section along line A-A of FIG. 6*a*, with the nose piece in a second angular orientation.
Figure 6C:
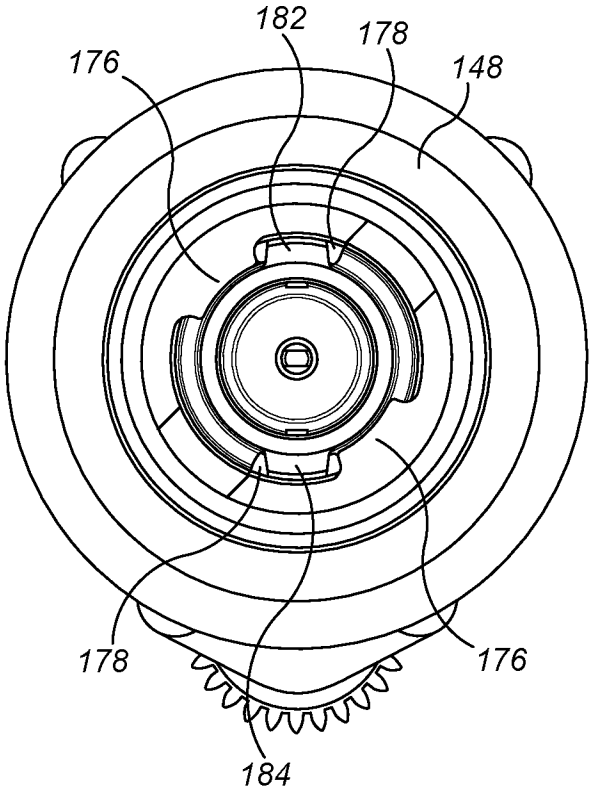
FIG. 6*c* shows a section along line A-A of FIG. 6*a*, with the nose piece in a first angular orientation.

Also, it will be appreciated that when the nose piece is rotated clockwise, as shown in FIG. 6d, this actuates the second cycle (jaw 150 clamp or release). The tab pairs 176 and 178 rotate with nose piece 148 to create a channel for the bayonet tabs 182 and 184 to move axially aft (or to the left of FIG. 11). Tab pair 176 prevents bayonet tabs 182 and 184 from over actuation axially in the fore-direction, thus creating a mechanical limit. This locks the rotation of ball nut 132 and any overload detected causes the clutch 142 to slip. Tab pair 176 act as a guide to prevent tool user from rotating the nose piece 148 during operation of this second cycle.

Reference now also to FIGS. 10d-10g illustrates the rivet placement cycle. As the motor 112 rotates and causes concomitant rotation of ball nut 132, then the barrel 104 advances axially to the right of the figures. Also, as the barrel stop member 180 is held on the helical groove 130 of the barrel 104 against axial movement, but is freely rotatable therearound, it also advances as the barrel 104 advances. FIG. 10(*e*) shows the barrel having advanced to the right by 10 mm compared to FIG. 10(*c*). It can be seen from FIG. 10(*c*) that the head 126 of mandrel 122 has started to be pulled through the rivet 124 because of the advancing barrel 104. This is part of the normal rivet placement process.

FIG. 10(*f*) shows the barrel 104 having moved 20 mm to the right from its home position. It can be seen that the stop member 180 is further to the right within the nose piece 148 and also that the mandrel head 126 has here moved completely through the distal rivet 124. The rivet has, therefore, been placed in a workpiece at this stage.

In normal operation, counting of rotation of ball nut 132 indicates that the rivet 124 would have been placed and that rotation of motor 112 should be reversed to return barrel 104 to its home position. However, should this not occur for some reason, such as inability for proper placement of the distal rivet 124, or inaccurate counting of the number of revolutions of the ball nut 132, the situation shown in FIG. 10(*g*) could occur. In this figure, it can be seen that the maximum fore-movement (here, 25 mm to the right of the barrel home position of FIG. 10(*d*)) has been reached. Not only have the bayonet tabs 182, 184 contacted their respecting nose piece tabs 176, or 178 (thereby to prevent further advancement of barrel 104), but the clutch 142 has disengaged by teeth 170 ramping over teeth 172, thus preventing any further driving torque being applied by the motor 112 to the ball nut 132.

Figure 13:
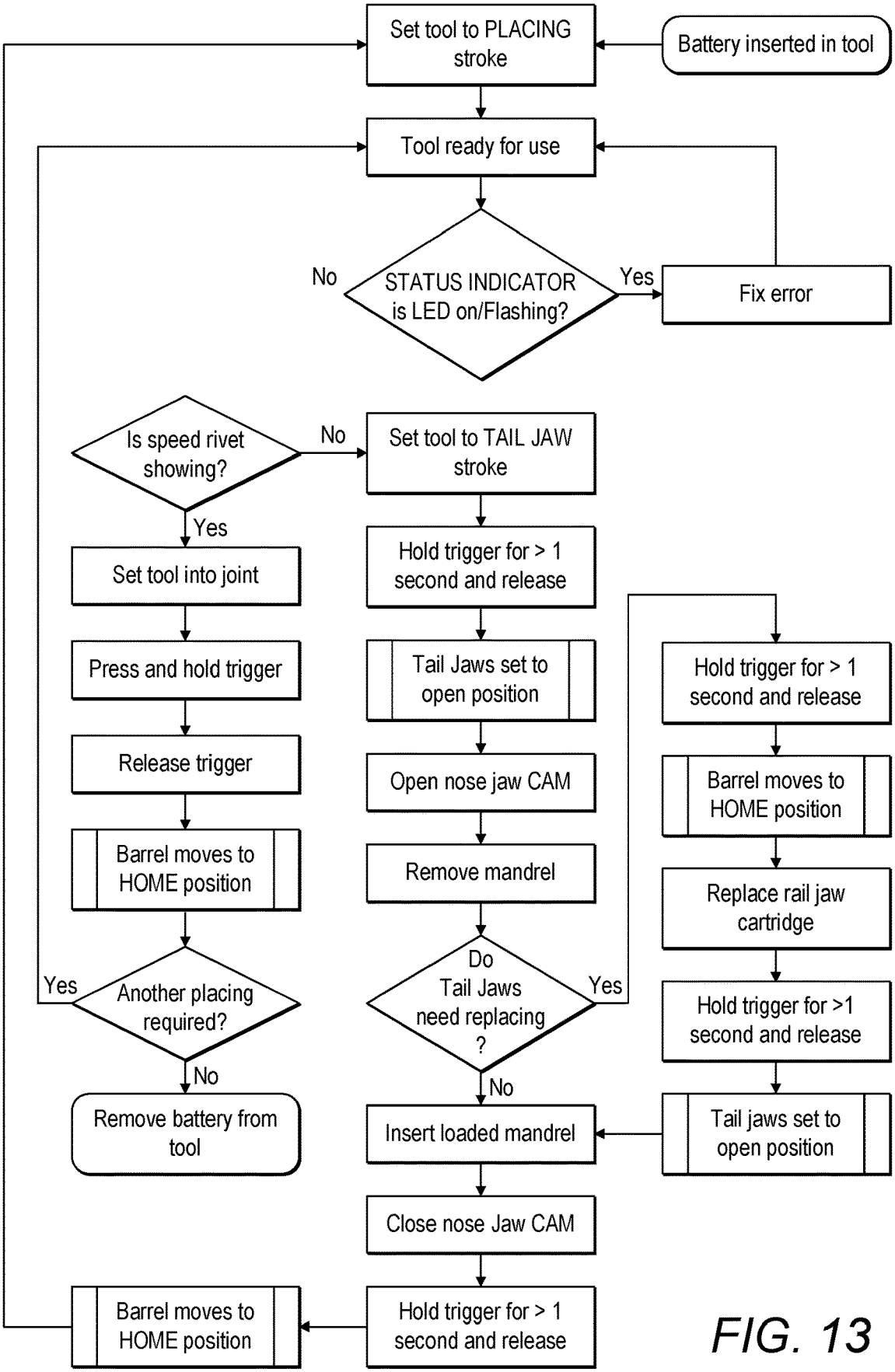
FIG. 13 illustrates a flow-chart of the overall functional tool operation.

According to the flow chart of FIG. 13, if the condition shown in FIG. 10(*g*) occurs (ie either full fore-movement of the barrel 104, or disengagement of clutch 142) occurs, then the motor reverses its rotation to immediately return the barrel 104 to its home position of FIG. 10(*d*).

Once the barrel 104 is returned to the home position of FIG. 10(*d*) (and assuming the previous rivet 124 has been placed and is not, for example, blocking the nose jaw assembly 110 by having been mis-placed), then the next rivet of the series of rivets 124 held on mandrel 122 can be placed. In order to commence placement of the next successive rivet, the operator of the tool 102 (leaving the nose piece 148 set to the first cycle position) simply depresses the trigger 108 and the first cycle starts again, as above.

At some stage, the tool 102 operator will wish to cease placing rivets by using the first cycle. This could happen when the series of rivets 124 held on the mandrel 122 have all been placed, or if there is a need to change the dimension of the rivets to be placed (eg for larger or smaller rivets). This will require release of the mandrel 122 by the jaws 150 so that a new (or newly rivet-loaded) mandrel can be placed in the tool 102. In order to release and replace the mandrel 122, the nose piece 148 needs to be rotated to its second position, at which the tool is operated in its second cycle.

Once the nose piece is rotated to the correct orientation for operation of the second cycle, the operator then actuates the trigger 108 which causes the motor 112 to rotate such as to cause concomitant rotation of the ball nut 132 to move the barrel 104 in its aft-direction (to the left of all the figures).

FIG. 11 (*a*) shows the home position for the second cycle. In this example, this is the same home position as for the first cycle, but that need not necessarily be the case. It will be appreciated that the home position for the first and second cycles could be different, depending upon the internal dimensions of the tool and/or the length of the mandrel.

The bayonet tabs 182, 184 in the nose piece 148 in the home position of FIG. 11 (*a*) are at an axial position mid-way between the nose piece sleeve 186 and stop ring 188. The stop ring 188 prevents any further retraction of the end stop 180 during its aft-cycle.

The jaw spreader 144 formed at the proximal end of mandrel 122 can be seen in FIG. 11(*a*) to be to the right of and outside the confines of cartridge 118. This axial position of the jaw spreader 144 means that the resultant force acting upon the jaws 150 is the compression force felt by spring 152. This resultant force causes the jaws 150 to be pushed to the right of the figure, hence being forced radially inwardly, by the conical taper 154 of retainer nut 156, hence clamping the jaws 150 against the proximal end of the mandrel 122.

Referring also to FIG. 11(*c*) the home position of the second cycle can be seen in more detail, as the nose jaw assembly 110 is also shown. Those skilled in the art will appreciate that, during the second cycle, a significant feature of the nose jaw assembly 110, is that it releases the distal end of mandrel 122 so that an operator may remove the mandrel from the tool by pulling it to the right of the figures. This can also be achieved if the mandrel is supplied as a single unit, including the jaw assembly 110. The expanded views shown in FIG. 11(*d*) of each of the respective portions of FIG. 11(*c*) show the major functional areas of the tool 102 at the home position and as the second cycle commences.

FIG. 11(*d*) and those of 11(*e*) show the situation where the second cycle has moved the barrel 104 axially in its aft-direction (to the left of the figures) by 6 mm compared with the home position. Here it can be seen that, as the rotation of motor 112 has caused concomitant rotation of ball nut 132, then the barrel 104 has moved axially aft by 6 mm and so the jaw spreader 144 has moved within the confines of the cartridge 118 and contacted the foremost (ie the right-hand side) of moveable jaw turret 160.

Continued aft-motion of barrel 104 results in the compression force of spring 152 being overcome by the torque of motor 112 applied thereagainst via ball nut 132 rotation, as seen at FIG. 11(*f*) where the barrel 104 has moved to the left from its home position by 10 mm. In this position of FIG. 11(*f*) of the barrel 104, it can be seen that the jaw spreader 144 has moved the jaw turret 160 so far to the left that the jaws 150 have moved radially outward along the taper 154 to such a degree that they are now free from the mandrel 122. The operator of the tool 102 may now remove the mandrel 122.

Once the operator inserts a new mandrel into the tool 102, they may then actuate again the trigger 118 to complete the second cycle. As seen from the flow chart at FIG. 13, this reverses the sense of rotation of motor 112 and, therefore, also ball nut 132 in order to move the barrel 104 axially forward to its home position. As with the first cycle, the second cycle is controlled by counting the number of turns of the ball nut 132, whether this be to release or the re-set the jaws 150. As with the first cycle, in the event of a control error causing the over-movement (either fore- or aft-) of the barrel 104, the clutch 142 will slip before an over-torque situation can arise.

Figure 12:
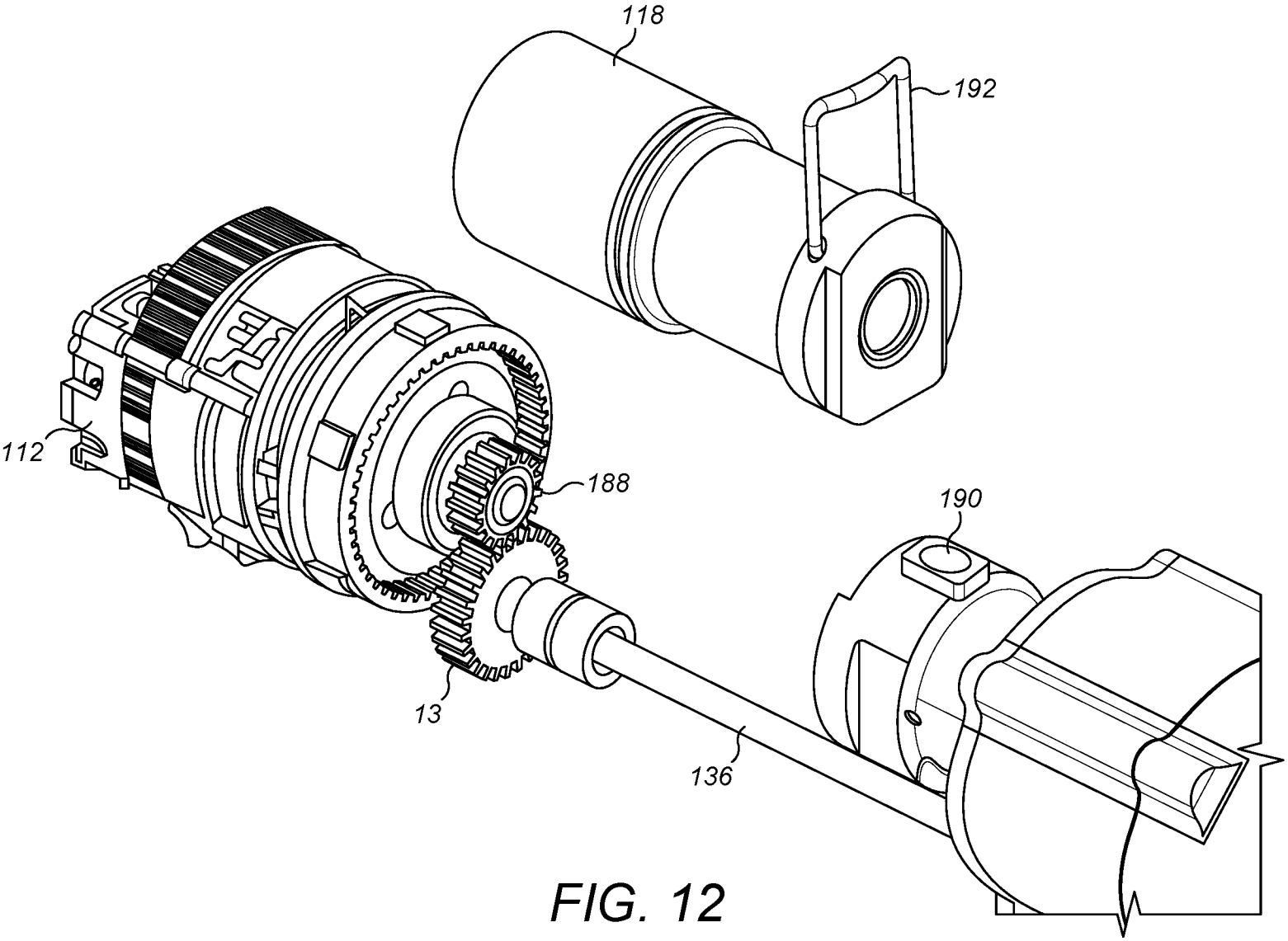
FIG. 12 shows a part exploded view of the jaw cartridge assembly and its fitment within the tool.

As mentioned above, in this example of the present invention, the jaws 150 are part of a replaceable cartridge 118. Such a cartridge is shown in more detail at FIG. 12. Here it can be seen that the motor 112 output is a pinion 188 which, when the cartridge 118 is placed in the tool 102, operatively engages with pinion 138, to impart rotational drive to the drive shaft 136. The benefit of a replaceable jaw cartridge 118, instead of discrete jaws built into the tool 102, is that servicing becomes an easy operation. All an operative need to do, should, for example, the jaws become worn, is to operate the latch 190 to release the cartridge form the tool 102, lift out the cartridge from the tool via handle 192 and replace the cartridge 118 with a new one.

Looking now at the control/operation flow chart of FIG. 13, it can be seen that, as discussed above with reference to the rotation of the nose piece 148, the tool 102 user is able to set the cycle to either the first ("Set tool to PLACING stroke"), or the second ("Set tool to TAIL JAW stroke"), depending upon the angular orientation of the nose piece. This cycle setting is determined, for example, by which microswitches complete an electrical circuit, as discussed above. However, those skilled in the art will appreciate that any suitable way to achieve setting of the wanted tool cycle is efficacious.

From the foregoing, it will be understood that during the first cycle (placement of successive rivets 124 from the mandrel 122), movement of the jaws 150 is not possible. In other words, it is essential that the jaws 150 stay in their clamped (radially inward) position during the entirety of the first cycle. Equally, during the second cycle (jaw release and re-placement), it is essential that the rivet mandrel 104 cannot be operated in a rivet placement cycle. This means the first and second cycles are mutually-exclusive and the operation of one precludes the operation of the other until the one is fully complete.

Those skilled in the art will appreciate from the above that the drive assembly comprises all features which take the rotational output of motor 112 and convert this into the linear axial movement of the barrel 104. So, whilst in the above example, this includes the pinions 138, 140 and their engaging drive shaft 136 and ball nut 132, other parts may also be involved with this transfer of drive. Indeed, those skilled in the art will appreciate that alternative means for taking the motor rotational output and converting this into a linear barrel movement are possible. For example a rack and pinion or a timing belt arrangement would also function well.

Figure 10B:
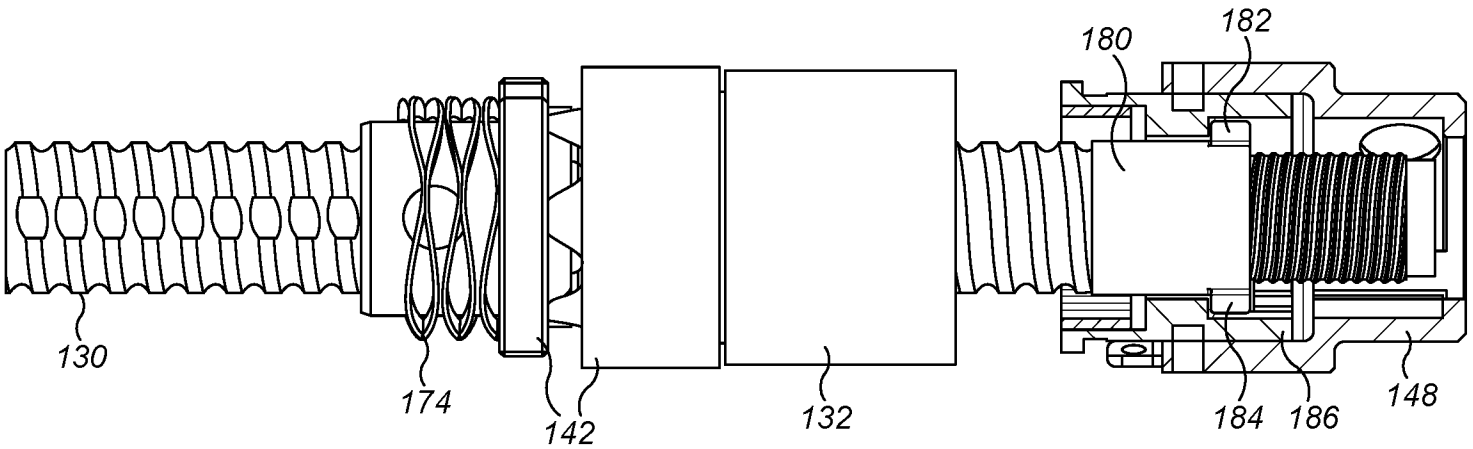
FIG. 10*b* shows a part-sectioned side view of the clutch and nosepiece of the tool before the rivet placement cycle commences.
Figure 10C:
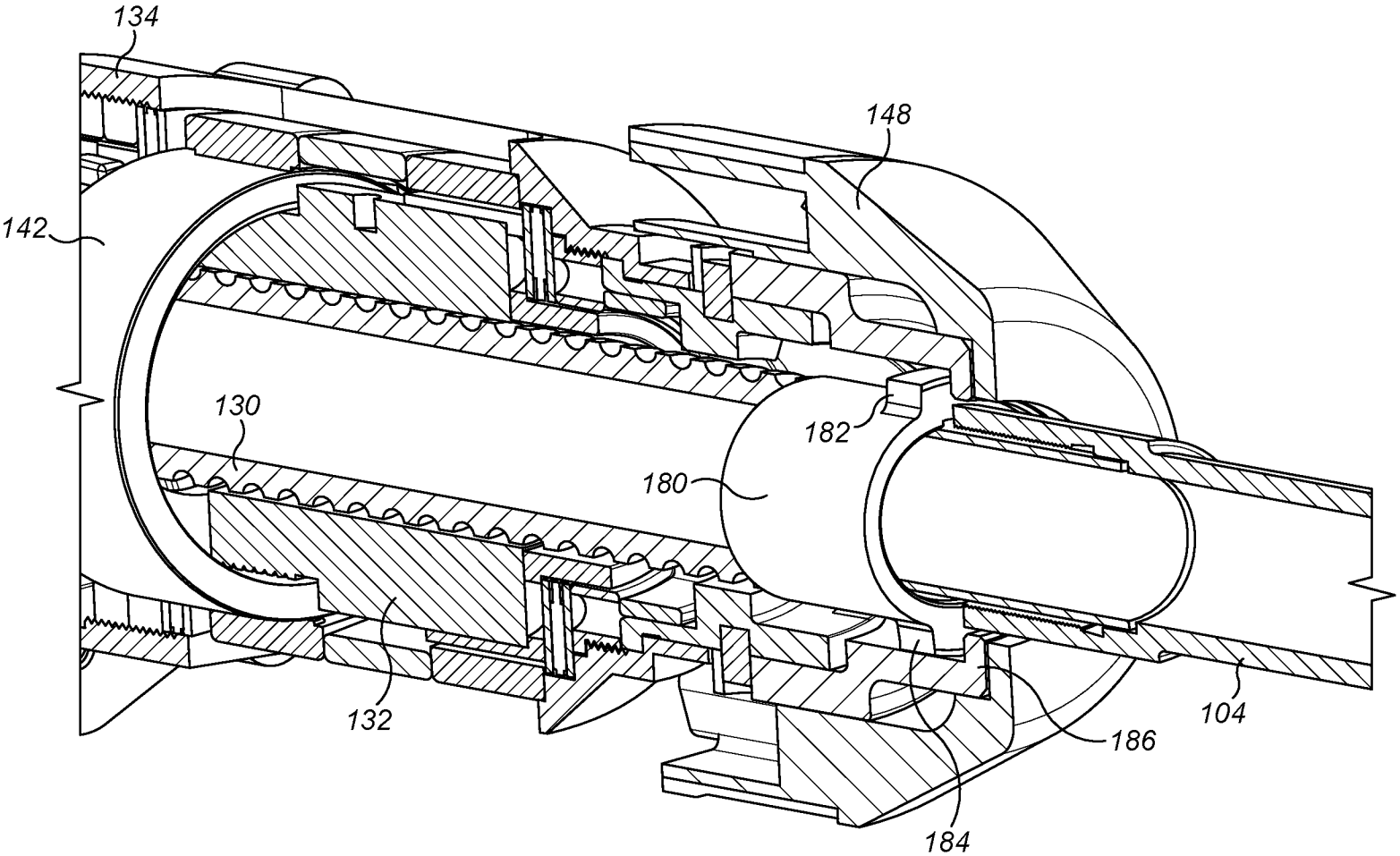
FIG. 10*c* shows a perspective sectional view of the same components as in FIG. 10*b*.
Figure 10D:
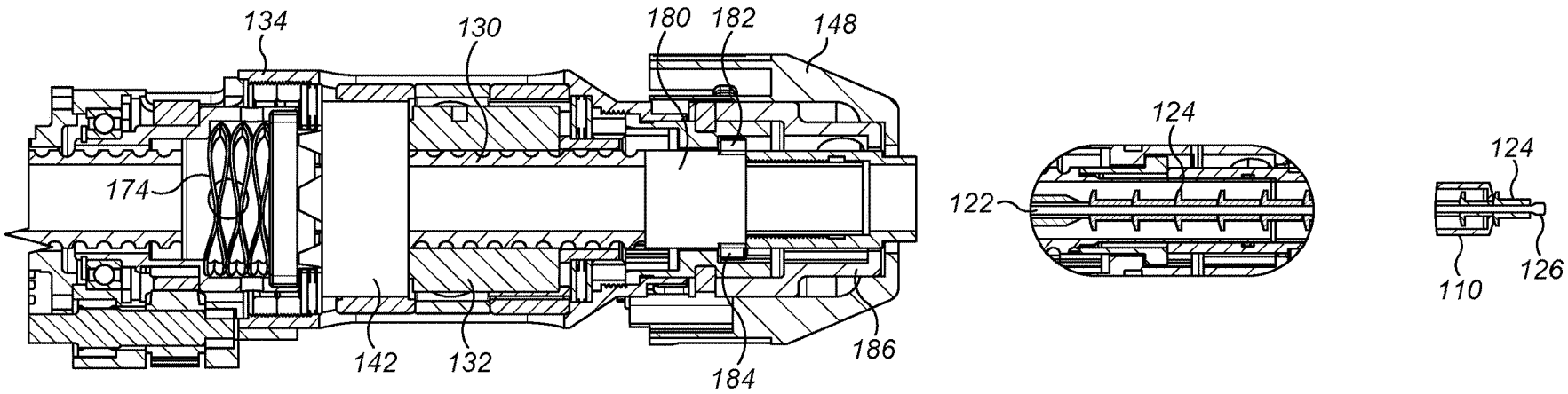
FIGS. 10*d*-10*g* show part sectional views of salient components of the tool during the rivet placement cycle of the tool.
Figure 10E:
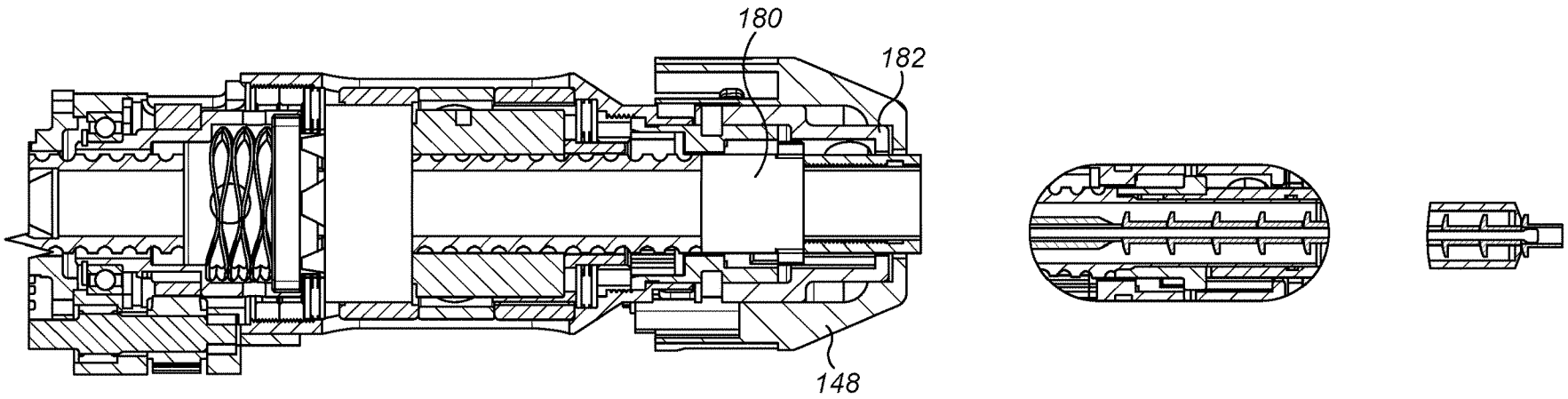
Figure 10F:
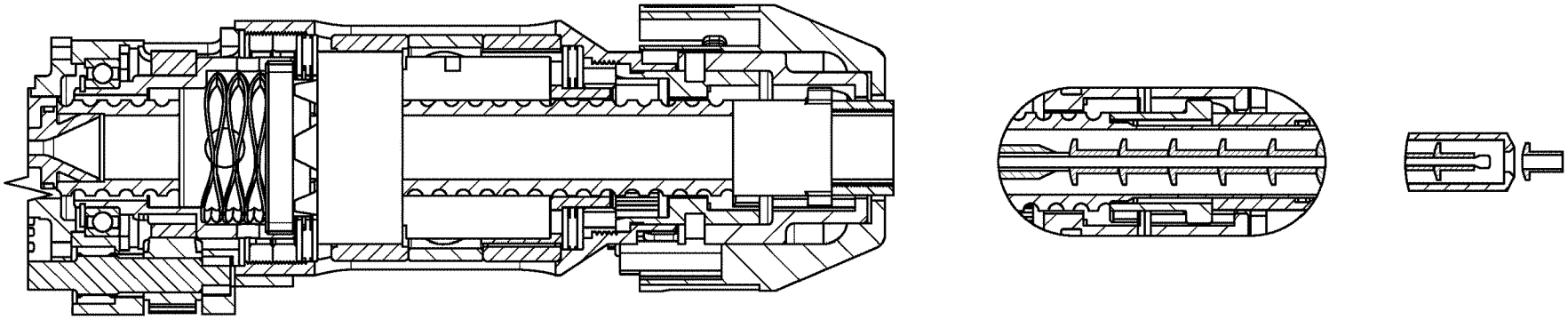
Figure 10G:
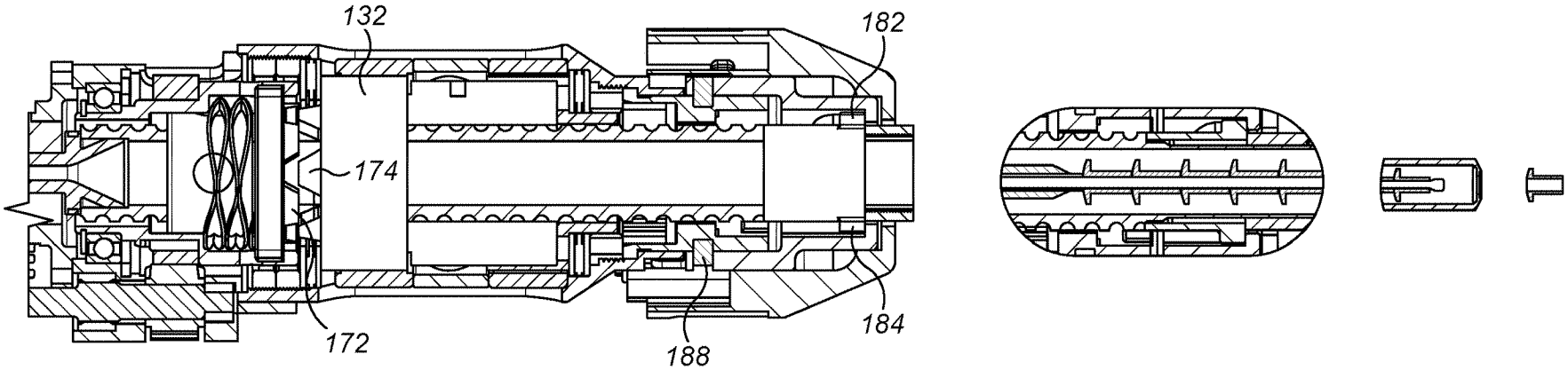
Figure 11A:
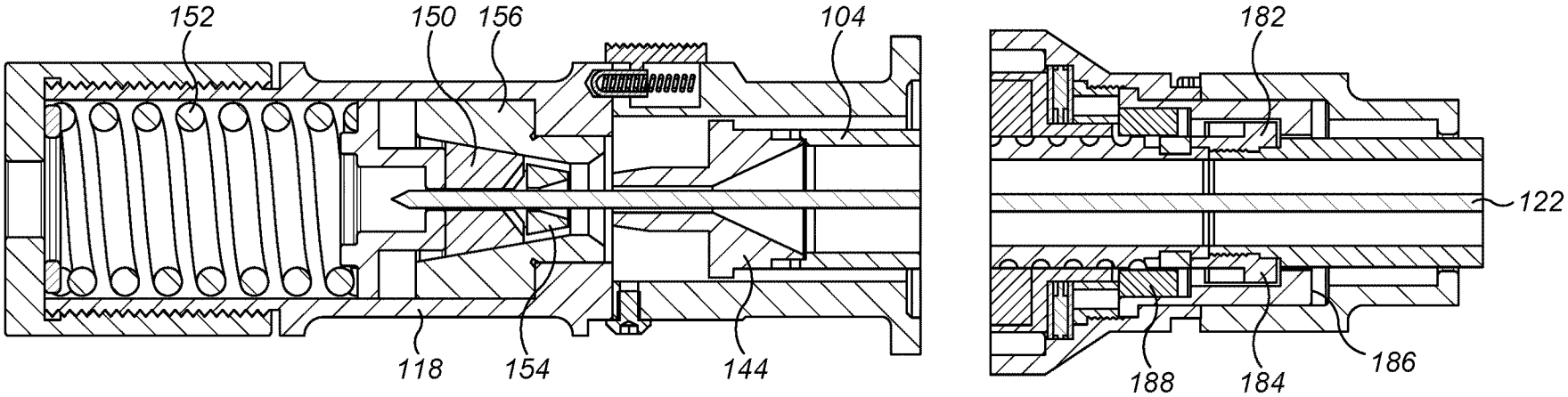
FIG. 11*a* shows, on the left-hand side thereof a sectional view of the jaw cartridge and jaw spreader; and, on the right-hand side thereof, a sectional view of the nosepiece; both views during commencement of the second cycle of the tool for mandrel release.
Figure 11B:
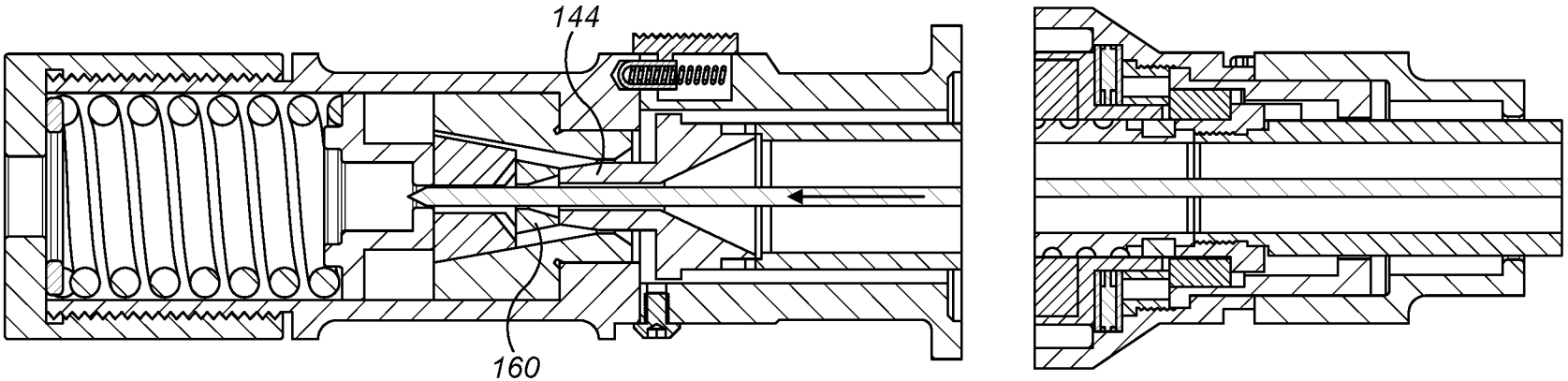
FIG. 11*b* shows corresponding views to those of FIG. 11*a*, but with the second cycle having progressed.
Figure 11C:
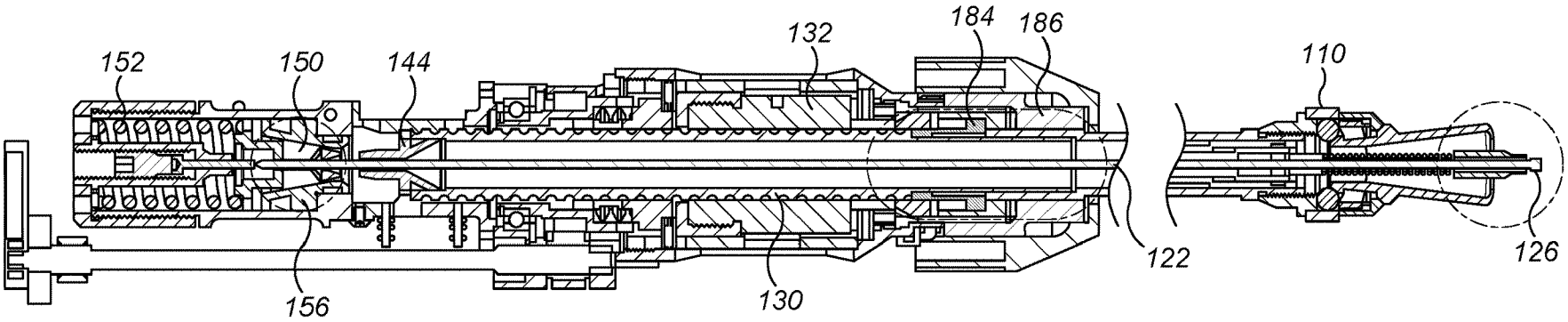
FIGS. 11*c-f* show part-sectional views of salient components of the tool during the second cycle for mandrel replacement.
Figure 11D:
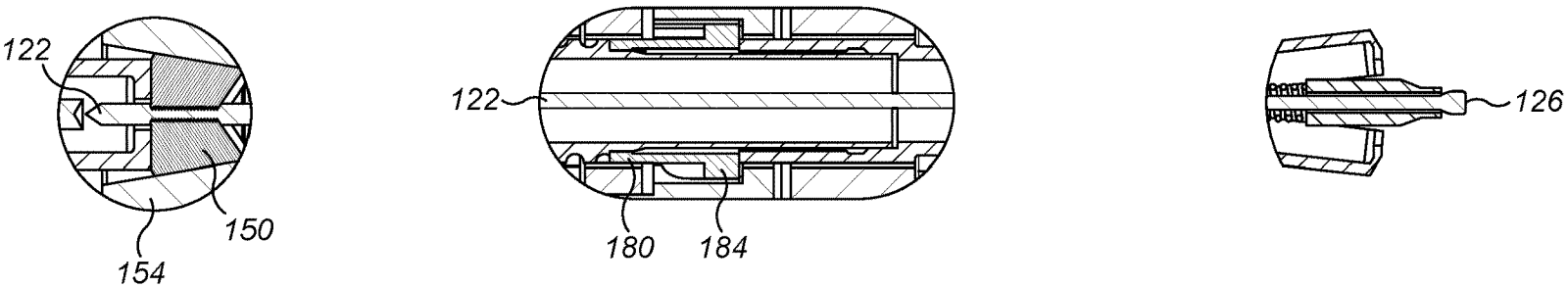
Figure 11E:
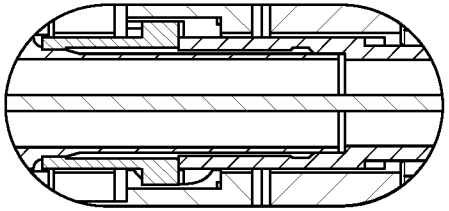
Figure 11F:
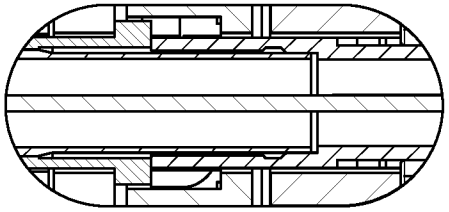

In the foregoing and with particular reference to FIG. 10*b*, the biasing of the clutch 142 by wave spring is an important feature. Those skilled in the art will appreciate that such forward biasing (ie to normally bias the clutch 142 into its engaged position) would be achieved by way of a conventional coiled compression spring. However (and with reference now also to FIG. 14) the wave spring 174 has been chosen to provide significant advantages over a conventional coiled spring. Particularly, the weight and space savings associated with the wave spring, with on loss of tension/compressive force is an advantage in the present invention. Wave springs also tend to provide a more consistent spring rate of return than coiled springs. The weight saving comes about by use of a plurality of separation and contact points (respectively, 194 and 196 in FIG. 14) providing a greater density of compression areas than in a coiled spring providing the same mechanical tension. This also permits the space saving, as the tension per linear metre is greater as a result.

In the foregoing, reference to counting the number of turns of the ball nut 1332 during tool operation is made. Those skilled in the art will appreciate any suitable method for such counting may be employed. For example, a mechanical counter, or software embodied in an IC may be equally-well employed.

LIST OF FEATURES

102 tool
104 barrel
106 handle
108 trigger
110 nose jaw assembly
112 electric motor
114 battery
116 drive assembly
118 jaw cartridge
120 switch
122 mandrel
124 rivets
126 head of mandrel
128 mandrel end stop
130 barrel external helical groove
132 ball nut 132
134 drive assembly casing
136 drive shaft
138 pinion
140 pinion
142 clutch
144 jaw spreader
146 dead stop
148 nose piece
150 jaws of cartridge
152 compression spring
154 conical taper
156 retainer nut
158 jaw serrations
160 jaw moveable holder
162 adjustable screw cap
164 front of jaw cartridge housing
166 clutch spur gear
168 clutch casing
170 $1^{st}$ set of clutch teeth
172 $2^{nd}$ set of clutch teeth
174 wave spring
176 nose piece tab 1
178 nose piece tab 2
180 barrel stop member
182 barrel stop member bayonet tab 1
184 barrel stop member bayonet tab 2
186 inner sleeve of nose piece 148
188 motor output pinion
190 cartridge latch
192 cartridge handle

What is claimed is:

1. A fastener placement tool for the sequential placement into workpieces to which the tool is presented of a series of fasteners, which fasteners are held captive on an axially-extending mandrel, the tool comprising;

a moveable barrel, within which barrel the mandrel may be inserted, and wherein axial movement of the barrel relative to the fasteners effects placement of the fasteners;

a jaw assembly having a plurality of jaws, each jaw of the plurality of jaws selectively moveable under influence of movement of the barrel to either restrain the mandrel from axial movement, or to release the mandrel therefrom;

an electric motor for providing motive force to move the barrel selectively for either i) fastener placement, or ii) jaws movement;

a drive assembly to convert rotation of the electric motor into movement of the barrel selectively either to place fasteners, or to move the jaws;

a switch operable by a user of the tool to control the selection of the electric motor to move the barrel for either i) fastener placement, or ii) jaws movement;

a clutch to selectively engage or disengage drive from the electric motor to the drive assembly.

2. The fastener placement tool of claim 1, wherein the movement of the barrel can be either a first cycle, wherein the fasteners are placed, or a second cycle, wherein the jaws are moved for restraint or release of the mandrel and wherein both the first cycle and the second cycle comprise axial fore-aft movements of the barrel.

3. The fastener placement tool of claim 2, wherein the clutch may disengage drive from the drive assembly to the barrel upon a predefined limit of movement being reached by the barrel in either of the first cycle or the second cycle.

4. The fastener placement tool of claim 3, wherein the clutch is intermediate the electric motor and the ball nut.

5. The fastener placement tool of claim 1, wherein the clutch is a bi-directional clutch.

6. The fastener placement tool of claim 5, wherein the clutch is biased towards its engaged position by a wave spring.

7. The fastener placement tool of claim 2, wherein the operation of the switch dictates which of the first cycle or second cycle the barrel undergoes.

8. The fastener placement tool of claim 1, wherein the jaw assembly comprises a replacement cartridge.

9. The fastener placement tool of claim 1, wherein the drive assembly includes a ball nut disposed intermediate the electric motor and the barrel, the ball nut to convert the rotational output of the electric motor into the axial movement of the barrel.

10. The fastener placement tool of claim 1, wherein the barrel comprises a proximal and a distal end, at the proximal end of which is formed a jaw spreader.

11. The fastener placement tool of claim 1, wherein the barrel comprises a proximal and a distal end, at the distal end of which is formed nose jaws for transferring the fasteners from the mandrel to a workpiece.

12. The fastener placement tool of claim 1, wherein the selective movement of the jaws includes radial movement relative to the axial extent of the mandrel.

13. The fastener placement tool of claim 1, wherein the selective movement of the jaws is axial movement relative to the mandrel.

* * * * *